United States Patent [19]

Muller

[11] 4,175,997

[45] Nov. 27, 1979

[54] APPARATUS FOR THE APPLICATION OF INDIVIDUAL PATTERN ELEMENTS IN SERIES TO A WEB-LIKE FLAT STRUCTURE

[75] Inventor: Hermann Muller, Herisau, Switzerland

[73] Assignee: Aktiengesellschaft Cilander, Herisau, Switzerland

[21] Appl. No.: 873,671

[22] Filed: Jan. 30, 1978

[30] Foreign Application Priority Data

Feb. 10, 1977 [SE] Sweden ..... 771650

[51] Int. Cl.[2] ..... B65C 9/08

[52] U.S. Cl. ..... 156/362; 156/553; 156/570

[58] Field of Search ..... 156/350, 351, 361–364, 156/367, 566–568, 571, 572, 519–520, 522, 552, DIG. 31, 583, 553

[56] References Cited

U.S. PATENT DOCUMENTS

| | | | |
|---|---|---|---|
| 2,878,953 | 3/1959 | Mitchell | 156/364 |
| 3,888,725 | 6/1975 | French | 156/DIG. 31 X |
| 3,892,617 | 7/1975 | De Preist et al. | 156/361 X |
| 3,904,466 | 9/1975 | Jones et al. | 156/571 X |
| 3,926,710 | 12/1975 | Weingrad et al. | 156/572 X |
| 3,964,953 | 6/1976 | Mitchard et al. | 156/570 X |
| 4,012,277 | 3/1977 | Lundskow | 156/571 |

*Primary Examiner*—David A. Simmons
*Attorney, Agent, or Firm*—Werner W. Kleeman

[57] ABSTRACT

An apparatus for the series application of patterns in the form of individual pattern elements to a spread, web-like flat structure, which pattern elements adhere thereto upon application of pressure and/or heat, comprising a transport device for the step-wise transport of the flat structure to which patterns are to be applied past work stations. At least one device serves for lifting at least one pattern element from a stack of pattern elements arranged upon a support, for transporting such lifted pattern element over the flat structure and depositing such thereon at a first work station. There is also provided at least one pressure and/or heat exerting device in order to adheringly bond the pattern element deposited upon the flat structure at a work station which follows the first work station in the direction of travel or transport of the flat structure. Control means serve for the step-wise transport of the flat structure past the work stations and control the working operations of the aforementioned devices in such a manner that when the flat structure is stationary, pattern elements are deposited thereon and at the same time previously deposited pattern elements are connected with the flat structure.

13 Claims, 9 Drawing Figures

APPARATUS FOR THE APPLICATION OF INDIVIDUAL PATTERN ELEMENTS IN SERIES TO A WEB-LIKE FLAT STRUCTURE

BACKGROUND OF THE INVENTION

The present invention relates to a new and improved construction of apparatus for the series application of patterns to a spread, web-like flat structure in the form of individual pattern elements which can be bonded with the flat structure by the applicaton of pressure and/or heat.

It is known to the art to apply patterns to flat structures, for instance knitted or woven textiles or textiles formed of fleece, also to carpets and the like, predominantly manufactured individual pieces formed of textile material, for instance, formed of natural fibers, regenerated fibers, synthetic fibers or mixtures thereof, but also synthetic leather, plastic foils and plates or the like, by bonding to the flat structure pattern elements placed thereon in the form of sublimable dyes, transferable pigment dyes or pattern blanks in that for bonding purposes an adhering layer of the pattern elements is activated by application of pressure and/or heat.

With the frequently employed so-called transfer printing processes used for this purpose, the pattern elements are applied to a substrate or carrier, preferably formed of paper, from which they are detached by application of pressure and/or heat and transferred to the flat structure to which the pattern is to be applied.

When using such transfer printing process for fabricating larger meter length of goods, for instance, during applying patterns to larger lengths of textile webs, as a general rule pattern transfer is accomplished continuously by means of transfer calenders from printed paper webs. Yet, production of such printed paper webs is rather complicated, requires the use of relatively expensive engraving of intaglio printing cylinders, templets and so forth, which only justify the use of such paper webs for large production orders.

In contrast thereto, during the application of patterns to individual pieces, for instance T-shirts, blouses and the like, manual operated presses are used instead of transfer calenders. For this mode of operation there can be used individual pattern elements, and for transfer printing, for instance, when working with price favorable offset printing processes, there can be employed paper sheets as the carrier having imprinted thereon the pattern elements and the design costs of which are considerably lower. The transfer process heretofore employed with individual pattern elements is expensive both in cost and work due to the need to apply the pattern elements manually, and therefore, is uneconomical for the printing of textile webs.

SUMMARY OF THE INVENTION

Hence, it is a primary object of the present invention to provide a new and improved apparatus for applying in series patterns to a substantially web-like flat structure in a manner not associated with the aforementioned drawbacks and limitations of the prior art proposals.

Another and more specific object of the present invention aims at the provision of a new and improved construction of apparatus by means of which it is possible to apply patterns only partially but true in the pattern repeat to a web-like flat structure, and instead of as heretofore with manual operations, at least semi-automatically, while utilizing pattern elements in the form of inexpensively fabricated transfer printing paper sheets, blanks or punched or stamped parts, throughout the web length and width.

Another significant object of the present invention and in keeping with the immediately preceding objective, is to apply patterns to web-like flat structures, and specifically also to webs of smaller meter length in a rational manner so as to achieve novel pattern effects, for instance, printed motifs adjacent or between embroidered parts or woven fantasy effects, or to produce such upon plate textiles, and specifically, if desired, to also produce patterns not obtainable by means of transfer calenders owing to the required use of paper webs extending over the entire length and width of the goods.

Now in order to implement these and still further objects of the invention, which will become more readily apparent as the description proceeds, the apparatus of the present invention is manifested by the features that it comprises a device for the step-wise transport of the flat structure to which the patterns are to be applied past work stations. At least one device serves to lift at least one pattern element from a stack of pattern elements arranged upon a support, to transport such raised pattern element over the flat structure and to deposit such thereon at a first work station. Additionally, there is provided at least one pressure and/or heat exerting device in order to adheringly bond the deposited pattern element to the flat structure at a work station arranged after the first work station in the direction of transport of the flat structure. A control device or control means serves for the step-wise transport of the flat structure past the work stations and to control the working operations of both of the aforementioned devices in such a manner that whenever the flat structure is at standstill there are deposited thereon pattern elements and at the same time the previously deposited pattern elements are bonded with the flat structure.

With such apparatus of the invention it is possible to automatically apply patterns to web-like flat structures, especially textile webs, patterns constituting inexpensively manufactured pattern elements in the form of printed individual paper sheets or paper sections or pattern blanks.

The device for raising the pattern elements from a stack of pattern elements and for the deposition thereof upon the flat structure can be advantageously constructed such that it encompasses at least one suction device connected with a source of negative pressure. This suction device can by cyclically displaced or pivoted between a position over a pattern element stack and a position over the flat structure and can be raised and lowered in such two positions.

A further variant embodiment contemplates conjointly pivoting a number of suction devices about a common pivot axis by means of a respective arm and conjointly raising and lowering such plurality of suction devices. One of such suction devices is always located over the flat structure and at least one of the other suction devices, incorporating a suction plate, is located over a pattern element stack. In this way, the deposition speed of the pattern elements upon the flat structure can be e.g. doubled in relation to equipment having only one suction device, since the one suction device removes pattern elements from the support whereas at the same time the other suction device deposits the pattern elements onto the flat structure and which pattern elements previously were taken up during the preceding work cycle.

The same improvement in production can be realized if there are provided two suction devices which can be moved to-and-fro in transverse direction with respect to the transport direction of the flat structure over such simultaneously in cycle between two positions and can be conjointly raised and lowered in both positions. Again, in both positions one suction device is located over the flat structure and the other suction device is located over one of two pattern element stacks which in this case are arranged to each side of the transport device for the flat structure.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
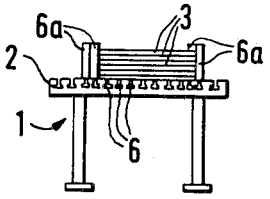
FIG. 1 schematically illustrates in side view a support table having a stack of pattern elements.

Describing now the drawings, reference character 1 generally designates a support table equipped with a support plate 2 for the reception of the pattern elements which are to be applied to a flat structure in a manner to be explained more fully hereinafter.

Figure 2:
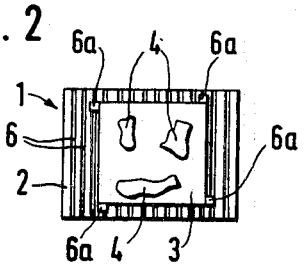
FIG. 2 illustrates the same table as shown in FIG. 1, but in top plan view.

Now in FIGS. 1 and 2 there have been illustrated pattern elements 4 which are imprinted in a manner known from the transfer printing process upon paper sheets 3 serving as a carrier. These pattern elements 4 can be detached from the carrier sheet 3 and by application of pressure and/or heat and bonded to a support or substrate against which they are pressed.

Figure 3:
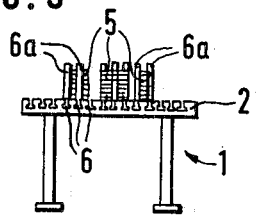
FIG. 3 is a view corresponding to that of FIG. 1 of a support table for the reception of a number of stacks of different pattern elements in the form of pattern blanks.
Figure 4:
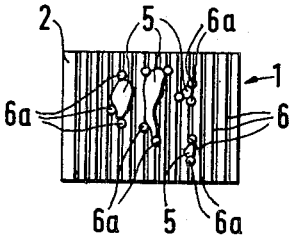
FIG. 4 is a top plan view of the table of FIG. 3.

In the modified construction of FIGS. 3 and 4 there have been shown pattern elements 5 in the form of bodies, for instance, fabric blanks which have been stamped out in a pattern shape, provided at one face with an adhering or adhesive layer which can be activated by pressure and/or heat and can be bonded as a unit at the flat structure, without there being required any carrier.

The pattern elements 5 and the pattern elements 4 together with their associated carrier sheet 3 are arranged in a reverse sequence from that in which they are transferred in series to the relevant flat structure. Furthermore, the pattern elements 5 and the pattern elements 4 together with the relevant carrier sheet 3 are disposed such that the surface intended to be deposited upon the surface of the flat structure leads, in other words are stacked downwardly in FIGS. 1, 3 and 5 upon the support plate 2 of the support table 1.

In order to ensure for an exact repeat of a predetermined pattern, on the one hand during a series pattern application to a web, but on the other hand also in order to exactly repeat the same pattern during a subsequent operation, there are advantageously provided adjustable stops 6*a*, to be discussed more fully hereinafter, ensuring for a positionally correct stacking of the pattern blanks or elements 5 and the carriers 3 for the pattern elements 4.

More specifically, there can be, for instance, provided for this purpose, as shown in FIGS. 1–6, a plurality of sunk slide rails 6 in the support plate 2. Into these slide or guide rails 6 there can be displaceably introduced stop means in the form of stop pins or rods 6*a* which protrude vertically from the surface of the plate 2. These stop pins or rods 6*a* bear against the marginal edges of the pattern elements which are to be positioned. These stop pins or rods 6*a* can be, for instance, frictionally or magnetically fixed in the rails 6 or also positionally fixed by means of set screws or equivalent structure so as to ensure for the correct position of the pattern elements or the like. Advantageously, the stop pins or rods 6*a* can be provided at their circumference with bristles, in order to render possible a still better and more secure positioning of the pattern elements, particularly small pattern elements.

Figure 8:
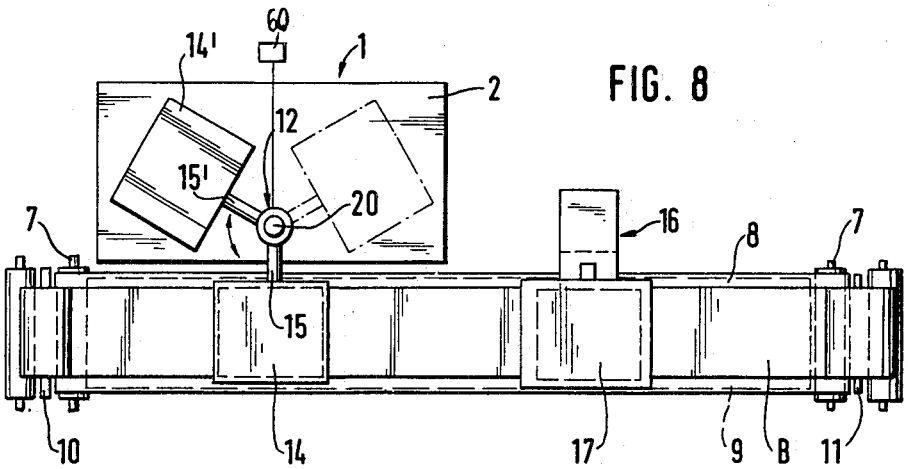
FIG. 8 is a variant of such apparatus in top plan view.

One such support table 1, or, if desired, a number of such support tables 1, are arranged for instance as shown in FIG. 8, adjacent a device by means of which a web-like flat structure B to which the pattern is to be applied, for instance a textile web, is advanced step-wise in a spread condition past each such support table 1. In FIG. 8 to improve the clarity of illustration, there have been conveniently omitted the showing of the guide rails 6, the stops 6*a*, and the pattern elements.

Figure 7:
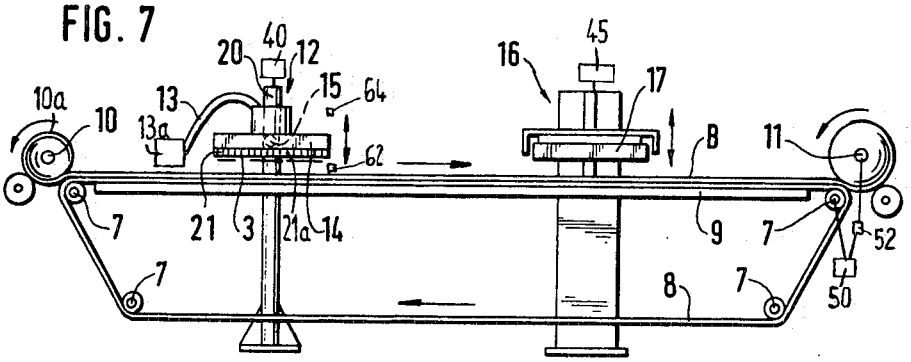
FIG. 7 is a side view of an embodiment of apparatus constructed according to the invention.

In the exemplary embodiment schematically shown in FIGS. 7 and 8, the equipment will be seen to comprise an endless transport element 8, for instance a revolving endless transport belt, trained about rolls 7 mounted in a not particularly referenced frame or housing. The endless transport band 8 travels between two rolls 7 over a horizontal support 9. The flat structure B to be patterned is in the form of a lap 10*a* wound upon a lap roll 10 and is payed-off therefrom, as illustrated, free of folds, onto the part of the transport band 8 supported by the support or support means 9, and at the end of the support means 9 is again wound-up onto a second lap roll 11 following the patterning operation which is still to be described. Step-wise drive 50 is provided for step-wise driving the transport band 8 and which, in standard fashion, can be accomplished by being operatively coupled to one or a number of the rolls 7. The drive 50 can simultaneously synchronously drive the lap rolls 10 and 11 which bear upon the transport band 8. These lap rolls 10 and 11 could also, if desired, be separately driven by slip couplings, as schematically illustrated by reference character 52 for the lap roll 11 at the right of FIG. 7.

According to a not particularly illustrated variant embodiment, it would be possible to dispense with the use of the lap or wind-up roll 11 and to, for instance, stack the patterned flat structure B upon leaving the transport band 8 or to directly introduce such into a further treatment station or installation connected thereafter.

Now for the transfer of the pattern elements which have been stacked upon the support table or tables to the flat structure B, there is provided in each case a transfer device, generally designated by reference character 12 in FIGS. 7 and 8.

As to the exemplary embodiment of FIG. 7, this transfer device 12 will be seen to comprise a suction device 14 connected by means of a flexible hose or conduit 13 with a schematically shown negative pressure source 13*a*. The suction device 14 can be horizontally pivoted or rocked at a pivot arm 15 between a position above the pattern element stack or stacks of a support table and a position above the flat structure B, and can be raised and lowered in such two positions. To perform such movements any suitable drive means 40 can be used. As will be explained more fully later, instead of accomplishing the foregoing movements, such device 14 also can be constructed, instead of being pivotable, so as to be displaceable between the above-mentioned two positions.

Continuing, as shown with the embodiment of FIG. 7, suction device 14 can be constituted by an apertured or perforated plate 21, whose openings or holes 21*a* are selectively connected with the negative pressure source 13*a*. If plate 21 is lowered onto a pattern element stack, then with the negative pressure applied thereto, it will be apparent that the uppermost pattern element of a stack or the stacks will be sucked against the suction openings 21*a* of the perforated or apertured plate 21, and upon pivoting or upon raising or lowering the suction device 14, such pattern element or elements will be entrained.

A suction device 14 which operates in this manner with the aid of a perforated plate 21 is advantageously employed in the first instance when applying patterns in the form of the pattern elements 4 of the type illustrated in FIGS. 1 and 2, in other words when working with the pattern elements 4 secured to a carrier sheet 3, since in this case the suction openings 21*a* are covered by the carrier or carrier sheet 3.

However, there can be used pattern elements or pattern element carriers of a size which do not ensure for positive suction application at the related perforated plate, since only a few of the suction openings or holes 21*a* are covered by such pattern elements or pattern element carriers, whereas false air can pentrate through a large number of the non-covered suction openings 21*a*.

Figure 5:
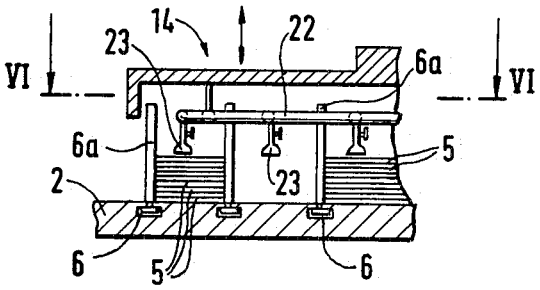
FIG. 5 is a vertical fragmentary sectional view through the support table of the arrangement of FIGS. 3 and 4, and through an embodiment of a suction device constructed according to the invention.
Figure 6:
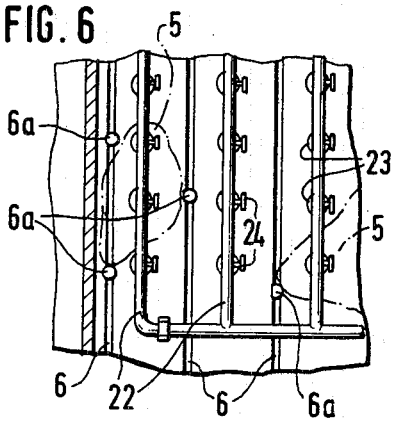
FIG. 6 is a cross-sectional view taken substantially along the line VI—VI of FIG. 5.

In such case it is therefore advantageous to use the suction device 14 of the type illustrated in FIGS. 5 and 6. With this modified construction of suction device 14 there is used instead of the perforated plate 21 of the arrangement of FIG. 7, a system of pipes or conduits 22 having a large number of therewith connected and downwardly extending suction cups or suction punches 23 or equivalent structure. These suction cups or suction punches 23, constituting suction elements, can be individually shut-off by means of the valves 24, and can be connected by means of the pipe or conduit system 22 with the suction air source, such as the negative pressure source 13*a* shown in FIG. 7.

If such suction device 14 is lowered with the suction elements 23 leading onto a pattern element stack, then all of the suction elements which do not come into contact with the pattern elements can be advantageously shut-off and the suction action therefore can be beneficially concentrated at those suction elements 23 which actually suck-off pattern elements or the like.

Furthermore, the interrupted configuration of the pipe or conduit system with appropriate relative arrangement of the individual pipes or conduits 22 with respect to the guide rails 6 ensures that the stop rods 6*a* or equivalent structure used for positioning the pattern elements can have at least a height equal to the entire height of the related pattern element stack, since these stop rods 6*a* or other stop means, upon lowering of the suction device 14, as will be particularly well seen by referring to FIG. 5, can enter into the intermediate spaces between the individual pipes or conduits 22.

A complete working operation of the device 12 is accomplished in a manner such that the suction device 14 located in its starting position over the pattern stack initially is lowered onto the pattern element stack and operatively connected with the negative pressure source 13*a*. Consequently, there is sucked-up the uppermost pattern element support 3 of the stack (FIGS. 1 and 2) or the uppermost pattern element 5 of the stack (FIGS. 3–6) is sucked-up. During the subsequent upward movement of the suction device 14, followed by a rocking or displacement of such suction device of the flat structure B and lowering thereof towards the flat structure, the thus sucked-up pattern element carrier or pattern element is held over the aforesaid flat structure B. At the end of the lowering movement onto the flat structure B, the suction air current is interrupted, so that prior to the subsequent return movement of the suction device 14 into its starting position over the pattern element stack, a pattern element carrier 3 with its pattern elements 4 or one or a number of pattern elements 5 are deposited at the region of the support means 9 onto the flat structure B.

As mentioned, the requisite working movements of the device 12 can be produced by any suitable mechanical, hydraulic or pneumatic drive means, as generally indicated by reference character 40 in FIG. 7.

Adjacent the first work station or location at which there are individually removed the pattern elements from the stack and which are to be transferred in the manner above-described and deposited onto the flat structure B, there is located, as viewed in the direction of feed or transport of such flat structure B, a further work station or location arranged after such first work station, but still at the region of the support means 9. This further work station contains a conventional press 16 incorporating a heatable press or pressure plate 17 which can be raised and lowered, by the drive means or motor 45, vertically over the flat structure B. In the operating position of the press 16, the press plate 17 is lowered onto the flat structure B and compresses such together between such press or pressure plate 17 and the support means 9. Consequently, pattern elements which have been deposited upon the flat structure B are transferred by the pressure and generally also by the heat of the pressure plate 17 onto the flat structure B, i.e., fixedly bonded therewith and thus simultaneously detached from any possibly present carrier. It is advantageous if the effective surface or area of the press or pressure plate 17 and particularly its extent in the web transport direction essentially corresponds to the surface or area of the suction device 14, so that during a single pressing operation, as will be described more fully hereinafter, the pattern element or elements deposited during one work operation or cycle by the device 12 can be effectively transferred to the flat structure B.

Finally, there is provided a control device or control means, not particularly shown in FIGS. 1–8, but further illustrated in detail in FIG. 9, which controls the hereinafter to be described automatic course of the series patterning of a surface structure with the illustrated equipment and coordinating the proper timewise actuation of the individual devices at the work stations or locations to one another.

The patterning operation occurs cyclically, and when using only a single suction device 14, only one support table 1 as well as only one press 16, in other words with an arrangement of the type schematically shown in FIG. 7, there occur repetitively the following two cycles or steps:

(a) The first cycle is accomplished with the web transport device inoperative, i.e., at standstill, and the suction device 14 is lowered onto the stack of pattern elements arranged upon the support plate 2, suck-up the uppermost pattern element or elements and, as the case may be, together with their carrier. The suction device 14 is now raised, and rocked into its second terminal position over the flat structure B, at that location lowered onto the flat structure B and by interrupting the suction current the pattern element or the pattern elements together with their support are deposited onto the flat structure B. Thereafter, the suction device 14 is returned empty back into its starting position. During this operation, in other words, during the same cycle, the press or pressure plate 17 is lowered onto the flat structure B. By applying the requisite pressure and/or thermal conditions needed for bonding the deposited pattern element or pattern elements the press plate 17 causes such to be connected with the flat structure B during the time needed for this purpose and then such press plate is again raised.

(b) During the second cycle, the transport element, here the transport band 8, is forwardly indexed or moved through one step, the length of which is coordinated to the length of the repeat of the pattern and advantageously equals such pattern repeat. Hence, there is again established the starting position prior to the first cycle and the operation can be repeated. The pattern elements which have been deposited successively in this manner by the above-discussed equipment onto the flat structure B, during a subsequent indexing step or movement of the transport band 8, arrive beneath the press 16 and at that location are transferred in the aforedescribed manner to the flat structure B. Thereafter, the flat structure B which has been patterned in this manner departs step-wise or incrementally from the illustrated equipment and can either be further processed while spread, stacked or otherwise handled at the end of the equipment or, as illustrated, wound-up onto the wind-up or lap roll 11.

Now if there are employed pattern elements 4 applied to carrier 3 and of the type shown in FIGS. 1 and 2, where below the press 6 the pattern elements 4 are detached from the related carrier 3, then the carrier 3 which loosely lies upon the flat structure B, following the press 16, can be manually or automatically removed from such flat structure before such departs from the equipment.

With apparatus of the type constructed according to the concepts of the invention, it is also possible to obtain pattern effects at a web-shaped flat structure, which are formed by overlapping transferred pattern elements or by using pattern elements of different thickness.

To this end, the device 12 is augmented by one or a number of suction devices 14 and there are correspondingly required at the first work station more than one support table or one support plate with correspondingly larger area for the reception of at least two stack places or stacks.

Such apparatus with two suction devices has been shown schematically in top plan view in FIG. 8. Both of the suction devices 14 and 14' are rotatably arranged for rocking or pivotal movement about a shaft or axle 20 at an angular spacing of 120° from one another and operatively connected with such shaft 20 by the respective pivot arms 15 and 15'. Both of the suction devices 14 and 14' can be selectively pivoted and raised and lowered by the control drive 60.

Also with this equipment the entire patterning operation is accomplished in two repetitive cycles. In particular, after placing into operation the equipment during which, with the web transport inactive, both of the operatively intercoupled suction devices 14 and 14' carry out the following individual operations:

As to the suction device 14': it is placed into operation over the support table plate 2, lowered, the suction operation initiated, and then again raised.

As to the suction device 14: it is placed into operation above the transport band 8, lowered, there is interrupted the suction current, and it is then raised.

(a) During the first cycle and as concerns the suction device 14': it is rocked through 120° in the counter clockwise direction, lowered over the flat structure B, there is interrupted the negative pressure, it is then raised, rocked through 120° in the clockwise direction back into its starting position, lowered over the support table, the suction operation is initiated, and it is then raised. At the same time, the other suction device 14 carries out the following operations: it is rocked through 120° in the counter clockwise direction into the phantom line position of FIG. 8, lowered over the support table in such position, the suction operation is initiated, it is then raised, rocked through 120° in the clockwise direction, lowered over the flat structure B, there is interrupted the suction air current, and it is then raised.

During this operation the press or pressure plate 17 is lowered, exerts its bonding or pressing operation for such length of time as needed to accomplish the relevant transfer process and then such press plate is again raised.

(b) During the second cycle there is accomplished the following: the step-wise forward movement of the conveyor band 8, as a result of which the flat structure B which is to be impressed with the pattern elements deposited thereon, is forwardly moved through the same repeat length.

As soon as the second cycle has been completed there again is repeated the first cycle.

The control means or control device determines the step-wise feed of the transport band or belt 8, the actuation of the press 16 and the device(s) 12 for the accurate pattern repeat transport of the pattern elements from the support table to the surface structure B advantageously with respect to one another such that upon turning-on the entire installation the drive means or drive motor 50 for the step-wise forward movement of the transport band 8 is actuated for movement of the latter through a pattern repeat length when the press plate 17 is located in its upper position, and at the same time also the suction device has completed its first cycle and again has returned empty back into its upper position over the support table. Since the time needed for the transport of the pattern element from the support table to the surface structure B is different from that needed for the pressing operation, because the latter, depending upon the transfer conditions lasts for a different amount of time, the forward movement of the transport band 8 is to be triggered by the movements of both devices 16 and 12 which require more time for accomplishing their own operations. As a general rule, such triggering operation is the press or pressure operation.

The coordination of the working steps of the device(s) 12 and 16 themselves is accomplished in that the device requiring the longer amount of time, as a general rule the press 16, triggers the operation of the other device, as a general rule the device 12. For instance, the press plate 17 triggers the transport of the pattern elements by the device 12 as soon as such press plate has moved out of its upper position and has been lowered. On the other hand, the device having the longest working duration, for instance the press, also triggers the forward movement of the transport band 8. As soon as the press 16 has reached its upper position, then the forward movement of the transport band through a predetermined, adjustable pattern repeat length, is triggered.

The control device also is assigned the task of controlling the suction current in a manner coordinated as a function of time with respect to the working operations of the device(s) 12. As soon as the suction device has reached its lower position over the support table, there is then triggered the suction operation between a ventilator or fan and such suction device by means of a valve, as will be explained more fully hereinafter with respect to the control means illustrated in FIG. 9. If the suction device 14 is located over the transport band 8, then the suction current likewise is interrupted, for instance by means of a contact switch 62 (FIG. 7) as soon as this suction device has reached its lower position. This contact switch 62 is to be arranged in such a manner that during the upward movement of the suction device 14 there is disconnected the negative pressure until the suction device again has reached its lower position over the support table.

Figure 9:
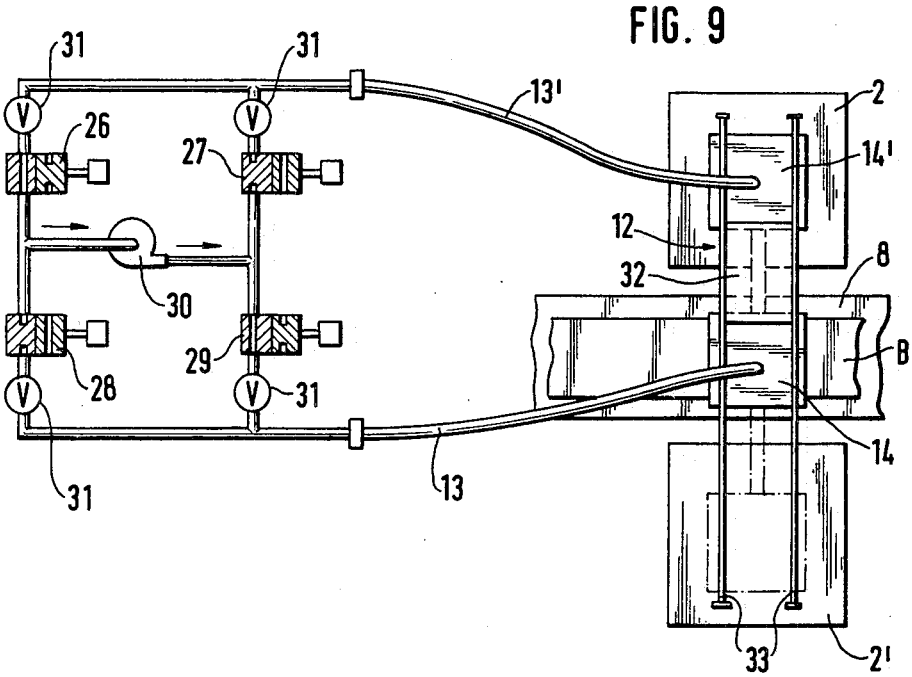
FIG. 9 schematically illustrates an exemplary embodiment of control device or control means for use with the apparatus of the invention.

When working with certain pattern elements which, for instance, due to a static charge, and upon interruption of the negative pressure do not readily detach from the suction device simply by the force of gravity, it can be advantageous to apply at the suction device a weak excess pressure thereto instead of only interrupting the negative pressure during such time span, in order to ensure positive detachment of the pattern elements from the suction device and their deposition onto the flat structure B, as will again be explained hereinafter with respect to the control circuit of FIG. 9.

Now in FIG. 9 there is schematically illustrated a possible construction of such type control for a device 12 having two operatively therewith coupled suction devices 14 and 14' respectively. Here, as a modification of the embodiment of FIG. 8, the suction devices 14 and 14' are not equipped with pivotal arms 15 and 15', and do not carry out the corresponding pivotal movements from the support table to the surface structure B and back again, as discussed above, but rather linear movements.

To this end, both of the suction devices 14 and 14' are arranged at a carriage or slide 32 which is guidable for movement to-and-fro between two end or terminal positions in guides 33 in a direction transversely with respect to the direction of movement or travel of the transport band 8. In the one terminal position, one of the suction devices is located over a support table 2 arranged to one side of and adjacent such transport band 8 and the other suction device is located over the flat structure B. In the other respective terminal positions of such suction devices, the first-mentioned suction device now is located over the flat structure B and the second-mentioned suction device is located over a second support table 2' disposed at the oppositely situated side of the transport band 8.

The negative pressure needed for sucking-up the pattern elements against the related suction devices 14 and 14' and the excess pressure for the positive detachment of the pattern elements for deposition and application onto the flat structure B is produced by a ventilator or fan 30. By carrying out appropriate valve switching operations, the pattern elements are applied at the correct point in time and positionally correct at the suction devices 14 and 14'. Operation of the valves 26, 27, 28 and 29 is accomplished advantageously by the provision of contact switches, such as the contact switch 62 discussed above in conjunction with FIG. 7, arranged at the device 12.

In particular, the aforementioned valves will be seen to comprise magnetic valves 26 and 27 operatively associated with the suction device 14', whereas magnetic valves 28 and 29 are operatively associated with the other suction device 14. Pressure regulating valves 31 enable regulation of the relevant suction and pressure air currents.

As will be seen from the illustration of FIG. 9, with the valve 26 open and the valve 27 closed, the suction device 14' is operatively connected with the suction air current.

These valve adjustments, controlled by the relevant contact switches, are maintained for such length of time until the suction device 14', following its displacement over the flat structure B, has been lowered thereon. During this time, preferably by means of a conventional adjustable timing relay, there is briefly closed, advantageously for about one second, the valve 26 and the valve 27 is opened. The brief pressure air surge or current which now is delivered out of the suction device 14' detaches therefrom the pattern element adhering thereto, and deposits such positively onto the flat structure B, while the suction device 14' is again raised and returned into its position over the support table. During this return movement of the suction device 14' it is possible by closing both of the valves 26 and 27 to interrupt any impingement of the suction device, i.e. to inactivate the same.

In analagous manner it is possible by means of the valves 28 and 29 to control application of the suction air current and the pressure air current to the suction device 14.

As will be readily understood, whenever the one suction device is shifted from its position over the support table into its position over the flat structure, at the same time there is displaced the other suction device connected to the carriage or slide 32 from the flat structure into a position over the related support table.

The transport band 8 advantageously consists of a material, which apart from possessing the requisite heat resistance, has the capability of faultlessly adhering with the web-shaped flat structure B, and displacing the same free of any relative movement cyclically forwards. It is possible to form the transport band 8 from fabrics having a rough surface or, however, also to employ transport bands having a heat-resistant permanent adhesive bond.

The vertical stroke of the suction device 14 or, as the case may be, the suction devices 14 and 14', can be controlled by means of a terminal switch 64 (FIG. 7), responsive to a counter-pressure and as a function of the continuously decreasing height of the pattern element stack arising during the progressive pattern applying operation.

With the described equipment, it is possible to transfer, apart from the already mentioned pattern elements imprinted upon a paper sheet serving as the carrier, analogously imprinted paper sections or imprinted paper blanks, and also pattern-shaped, cut, stamped or otherwise fabricated individual parts which can be transferred by pressure with or without thermal action, heat sealing or in another fashion, and which individual parts are formed of fabrics, knitted goods, fleece, leather, synthetic leather, felts, plastic foil or the like, and equally adhesively bondable, heat sealable or other types of transferrable embroidered motifs, threads, metal parts and the like in series to a flat structure or surface.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for the series patterning of a spread, web-like flat structure by means of individual pattern elements which can be bonded thereto by applying pressure heat, or both, comprising:

a plurality of work stations;

a transport device for the step-wise transport of the flat structure to which the pattern is to be applied past said plurality of work stations;

at least one stack of pattern elements;

support means for supporting said stack of pattern elements;

at least one device for lifting at least one pattern element from said stack arranged upon said support means, for transporting the lifted pattern element over the flat structure and for depositing such thereon at a first one of said work stations;

means for bonding the deposited pattern element at the flat structure;

said bonding means being arranged at a work station located after said first work station with respect to the direction of transport of the flat structure;

control means for controlling the step-wise transport of the flat structure past the work stations and the working operations of both said lifting device and bonding means, such that when the flat structure is at standstill there are deposited thereon pattern elements, and at the same time pattern elements which have been previously deposited are bonded with said flat structure;

said lifting device comprises at least one suction device having a plurality of suction elements;

a pipe system for operatively connecting said plurality of suction elements with one another;

means for defining a source of negative pressure operatively connected with said suction elements by means of said pipe system;

adjustable stop means cooperating with said support means for locating said pattern element stack in a predetermined position in staggered relationship to the pipe system;

said pipe system being arranged with respect to the adjustable stop means such that, with the suction device lowered onto the support means, said stop means are not contacted by said suction elements or the pipes of the pipe system.

2. The apparatus as defined in claim 1, wherein:

said bonding means serves to selectively apply pressure, heat, or both, for acheiving the bonding of the pattern elements with the flat structure.

3. The apparatus as defined in claim 1, wherein:

said bonding means serves to apply at least pressure for bonding the pattern elements with the flat structure.

4. The apparatus as defined in claim 1, wherein:

said bonding means serves to apply at least heat for bonding the pattern elements with the flat structure.

5. The apparatus as defined in claim 1, wherein:

said transport device for the transport of the flat structure comprises a step-wise driven transport band;

means for the step-wise driving of said transport band;

support means over which travels said transport band at the region of the work stations;

a wind-off roll from which there is payed-off the flat structure at which there is to be applied the pattern for delivering the flat structure in a spread and essentially fold-free condition to the transport band; and said drive means for the transport band being structured to simultaneously drive said wind-off roll.

6. The apparatus as defined in claim 1, further comprising:

means for cyclically moving said suction device between a position above the pattern element stack and a position above the flat structure and for raising and lowering such suction device in each of said two positions.

7. The apparatus as defined in claim 6, further including:

a plurality of said suction devices;

a common pivot shaft;

a respective arm for operatively connecting each suction device with said common pivot shaft; and said moving means comprising means for cyclically conjointly pivoting and conjointly raising and lowering said plurality of suction devices about said common pivot shaft, such that one of such suction devices is always located over the flat structure and at least one of the other suction devices is located over the pattern element stack.

8. The apparatus as defined in claim 6, further including:

at least two of said suction devices;

means for mounting said two suction devices for movement in a direction transversely with respect to the direction of transport of said flat structure for simultaneously cyclic movement of said two suction devices to-and-fro between two positions and for conjointly raising and lowering said suction devices in each of both positions;

one of said suction devices in one of said two positions being located over said flat structure and the other of said suction devices being located over a first of two of said pattern element stacks;

a respective one of each of said two pattern element stacks being arranged to each side of the transport device.

9. The apparatus as defined in claim 1, further including:

said adjustable stop means serving for the positionally correct arrangement of said pattern element stack.

10. The apparatus as defined in claim 1, wherein:

said suction device having a perforated plate equipped with openings;

said means for defining a source of negative pressure connected with the openings of the perforated plate for lifting by a suction action the uppermost pattern element of the stack located upon the support means.

11. The apparatus as defined in claim 1, further including:

means for shutting-off predetermined ones of said suction elements.

12. The apparatus as defined in claim 1, wherein:

said at least one suction device is movable up and down; and further comprising means for controlling the downward movement of each suction device as a function of the height of the pattern element stack.

13. The apparatus as defined in claim 1, wherein:

said at least one suction device can be moved up and down; and said control means includes means for infeeding for a short period of time air at a positive pressure to the suction device when lowered onto the flat structure.

* * * * *

UNITED STATES PATENT AND TRADEMARK OFFICE

CERTIFICATE OF CORRECTION

PATENT NO. : 4,175,997

DATED : November 27, 1979

INVENTOR(S) : HERMANN MÜLLER

It is certified that error appears in the above-identified patent and that said Letters Patent are hereby corrected as shown below:

On the title page, column 1, section [30], please read:

"Feb. 10, 1977 [SE] Sweden.....771650" as

--Feb. 10, 1977 [CH] Switzerland.....1650/77--

Signed and Sealed this

*Eleventh* Day of *March 1980*

[SEAL]

*Attest:*

SIDNEY A. DIAMOND

*Attesting Officer*

*Commissioner of Patents and Trademarks*